United States Patent [19]

Hepperle

[11] 4,190,927

[45] Mar. 4, 1980

[54] CURTAIN ROD TRACK FITTING

[76] Inventor: Erwin Hepperle, Hamletstr. 4, 7000 Stuttgart 80, Fed. Rep. of Germany

[21] Appl. No.: 870,036

[22] Filed: Jan. 16, 1978

[30] Foreign Application Priority Data

Jan. 11, 1977 [DE] Fed. Rep. of Germany ..... 2700838
Jun. 6, 1977 [DE] Fed. Rep. of Germany ..... 2726492

[51] Int. Cl.[2] ..... A47H 15/00

[52] U.S. Cl. ..... 16/96 D; 16/97; 16/106; 160/346

[58] Field of Search ..... 16/95 D, 96 D, 97, 106, 16/93 D, 94 D; 160/347, 346, 330

[56] References Cited

U.S. PATENT DOCUMENTS

| | | | |
|---|---|---|---|
| 581,475 | 4/1897 | Benson et al. | 16/96 D X |
| 592,795 | 11/1897 | Leslie | 16/96 D X |
| 1,083,954 | 1/1914 | Tatje | 16/97 |
| 2,538,434 | 1/1951 | Svendsen | 16/106 X |

FOREIGN PATENT DOCUMENTS

| | | | |
|---|---|---|---|
| 187157 | 7/1907 | Fed. Rep. of Germany | 160/346 |
| 4268 | 2/1956 | Fed. Rep. of Germany | 16/96 D |
| 25427 | of 1912 | United Kingdom | 160/346 |

*Primary Examiner*—C. J. Husar
*Assistant Examiner*—Moshe I. Cohen
*Attorney, Agent, or Firm*—Shlesinger, Arkwright, Garvey & Dinsmore

[57] ABSTRACT

A curtain rod track fitting and curtain rings for use therewith, the curtain rings being slideable on the curtain rod and being provided with a slide or roll device trued to the middle of the ring and supported on the rod in such a manner that the plane of the ring runs normally substantially perpendicular to the longitudinal axis of the curtain rod, and the rings are reciprocally movable around a horizontal axis running transverse to the curtain rod.

7 Claims, 10 Drawing Figures

CURTAIN ROD TRACK FITTING

The invention relates to a curtain rod track fitting consisting of a curtain rod and a plurality of curtain rings which slide on the track, held on brackets, on which the top of a curtain or the like is suspended.

Known curtain rod track fittings use round curtain rods of wood, plastic or wrought iron and suitable rings moved along the rod. With long curtain rods for large windows, difficulties are often met in moving the curtain which is suspended on the rings, particularly if the curtain rod is at a great height. These difficulties result primarily from the friction between rings and curtain rod, which increases with curtain weight and with the traction applied by the user standing before the curtain, which traction acts on the rings not in the direction of the curtain rod but rather at an angle thereto.

Since the ring diameter is considerably greater than the rod diameter, the rings can twist under the effect of the traction which is applied nonuniformly across the curtain with pushing of the curtain, so that they apply stress not only on the top but also on the sides of the curtain rod, and thus increase the friction. This results in more difficult operation and danger of damage to the curtain and accessories. These disadvantages are overcome by the invention, wherein the friction occurring primarily by twisting of the rings is avoided, and the rings can still be moved easily.

The invention discloses that the rings are provided with a slide or roll device trued to the middle of the ring, and are braced over this device on an upper track and are supported with some clearance in such a manner that the ring plane normally runs vertical to the longitudinal axis of the curtain rod, but the rings can also move reciprocally around a horizontal axis running traverse to the curtain rod. In this manner, each curtain ring is so braced, with the curtain load suspended on it, over the slide or roll device on the track, and is simultaneously so supported that it cannot twist. The curtain ring is braced on the track with small mounting surface, almost by points only, and is reciprocally movable, and yet twisting is prevented when forces occur even from other than the direction of the rod with pushing or pulling on the curtain.

The fundamental concept of the invention can be realized in various manners. In a first embodiment, the rings have a projection directed toward the middle of the ring with side support surfaces, and the projection has a slide or roll body for the transverse axis, which is braced on the bottom of a C-shaped track housed in the curtain rod, while the side support surfaces of the projection are supported with clearance on the edges of the opening of the track. The projecting part, preferably an integral part of the ring, serves simply for support and prevents twisting of the ring, so that the slide or roll body, around the axis of which the ring can move reciprocally, can meet its slide or roll function unhindered.

In a second embodiment of the invention, the curtain rings are each supported by a holder casing surrounding an upper ring segment with some play, the part of a slide support in a C-shaped track of the curtain rod which is open upward. The slide has integral side enlargements at a certain distance above the head supported in the track, which enlargements engage sliding on the top of the track. Here the head which is supported in the track or on its opening edges serves in such a manner that the curtain ring does not twist, while the slide or roll function of the enlargements resting on the top of the track is taken over. The ring is braced in the holder casing and thereby is mounted to move reciprocally. By tapering of the head to the outside parallel to the brack device, the head can be pressed in to catch in the track when the slide is tilted from above. This allows a comfortable insertion of slides at any desired point into the track, whereby curtain rings which are open on one side can be used, which can slide on a bracket and can basically be used in all embodiments, if the rings cannot be shoved on the end of the curtain rod or if brackets must pass over.

In another embodiment of the invention, the rings have a cutout, in which is mounted a roller which has one peripheral surface resting on the track and two support surfaces lying opposite the side surfaces of the track with clearance to assure that the rings do not twist. The resting point of the ring is shifted by the roller mounted in the cutout of the ring up to the level of its inside periphery or still further upward, to obtain improved support stability and slide properties.

The roller mounted in the curtain ring basically has one supporting peripheral surface and two supporting surfaces engaging on the side walls of the track or running groove, whereby the support surfaces are formed by two outside rims or by the side surfaces of a middle rim. In a preferred embodiment, the roller mounted in the cutout of the ring is tapered to its periphery riding on the bottom of the running groove, while the distance between the opposite and essentially vertical side walls of the running groove is insignificantly greater than the width of the roller at the level of the roller segment rolling in the running groove. With this variation, the important advantage is obtained at the beginning of the ring movement not only that the roller can be positioned together with the ring and slightly tilted, and therefore the tractions can occur in slight deviation from the curtain rod direction for brief alleviation of the starting procedure, but also that the friction occurring with the inclined position of the roller between the top edges of the running groove and the side support surfaces of the roller remains limited to an area with slight clearance from the roller axis, and the friction force thus applying to a small lever arm produces only a negligeable braking moment.

The invention is described in the following relative to the embodiments shown in the drawings.

The curtain rod 10 is preferably of wood or of a metal or plastic tube with inside reinforcement rods, and in FIGS. 1–5 has a longitudinal groove at the top, in which is held a C-shape track 11, preferably open at the top.

Figure 1:
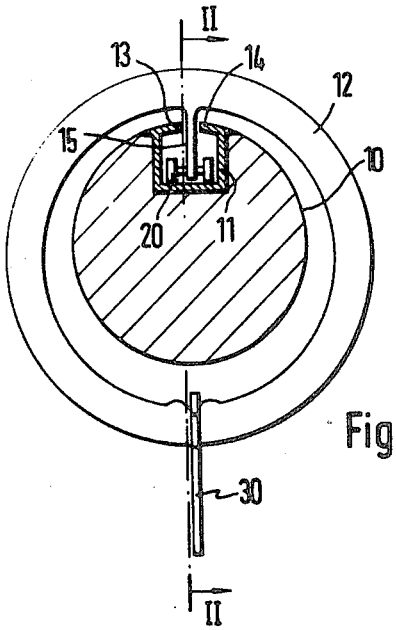
FIG. 1 shows a transverse cross section through a curtain rod with a curtain ring in one embodiment of the invention.

The top transverse arms 14 bordering the track opening 13 can be rounded as in FIG. 1. A projection 15, which is integral with the curtain ring 12, projects through opening 13, and in FIG. 2 has a cutout 17 accessible through a narrowed slot 18, in which is engaged a transverse axis 19 of the roller element shown in FIG. 1 or the slide element 20 of FIG. 2. Ring 12 is so supported over the side support surfaces of projection 15 in the track opening 13 that no noticeable twisting occurs. At the same time, the curtain 12 can move reciprocally around axis 19 which is braced through the slide shoe or roller on the bottom of the track.

Figure 3:
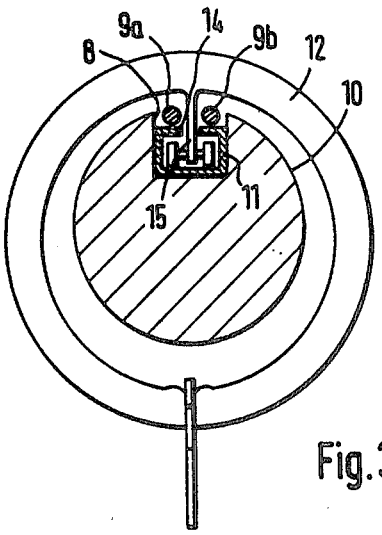
FIG. 3 shows a modification of FIG. 1 for a covered and supported housing of a draw cord for the curtain rings.

FIG. 3 shows track 11 mounted in a deeper longitudinal groove of curtain rod 10, or the top transverse arms are at a smaller distance from the track base, so that passages for a draw cord device exist between transverse arms 14, side walls 8 of the groove, and both sides of the projection 15 projecting into the track. The draw cord consists of an endless loop, which is inserted e.g. from a guide pulley mounted in the wall at one curtain end and through an end opening through the curtain rod passages shown in FIG. 3, whereby the one cord strand **9*a* returns after passing around a roller mounted at the other end of the rod as the second cord strand 9*b* in the other passage. One of the strands 9*a* or 9*b* is fastened to projection 15** of the first ring of the curtain.

Figure 2:
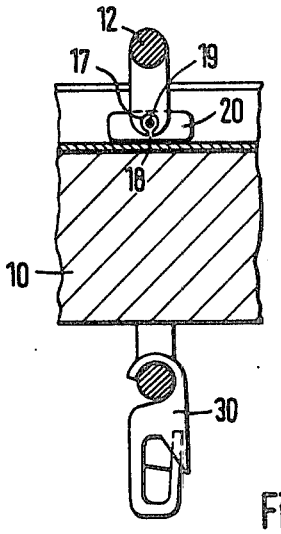
FIG. 2 shows a cross section along line II—II of FIG. 1.
Figure 4:
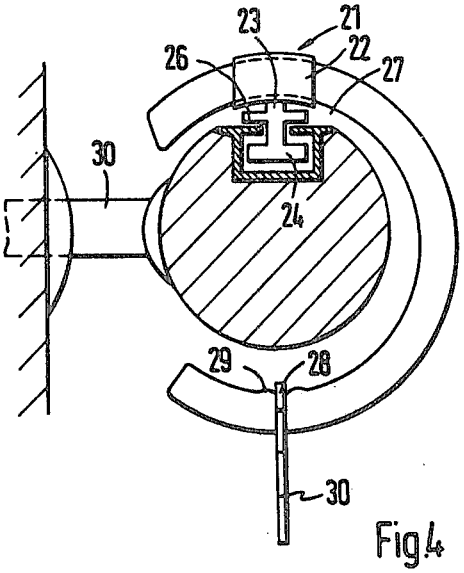
FIG. 4 shows a partially cutout view of a second embodiment of the invention.
Figure 5:
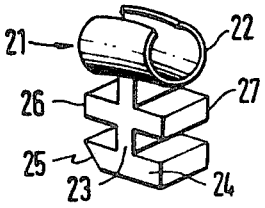
FIG. 5 shows a perspective view of the slide of FIG. 4.

The curtain ring and slide or roller element of FIGS. 1–3 preferably form a plastic unit, FIGS. 4 and 5 show a slide 21 provided with an integral holder casing 22, into which curtain ring 12 is inserted and which surrounds the ring with play, so that it can move reciprocally within a certain sector.

Slide 21 has a perpendicular bar 23 with an enlargement 24 at the bottom. FIG. 5 shows the head with an inclined side 25, so that it can be impressed into and removed from the track by use of force overcoming the material elasticity. Head 24 serves for longitudinal support of the slide, while enlargements 26, 27, farther up on bar 23, rest on the top of the track and support curtain ring 12.

The attachment of the curtain rod by means of a bracket K to wall W as shown in FIG. 4 necessitates the use of open curtain rings, whereby the opening width is only so great that the ring is shoved over the curtain rod with flexible expansion.

Figure 6:
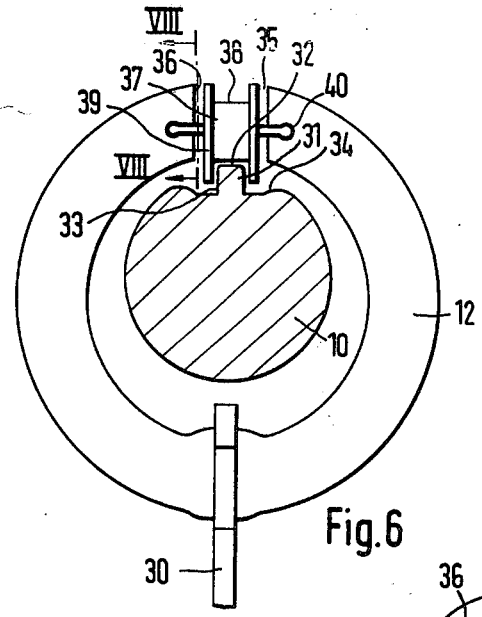
FIG. 6 shows a third embodiment in the same representation as shown in FIGS. 1 and 4.

One curtain ring 12 of foamed plastic (polyurethane) shown in FIG. 6 has a cutout 35 between the side walls 36 of which is mounted a roller 37. The roller surface 38 rests on the top 32 of a track 31 and two support surfaces 39 remain opposite the side surfaces 33 of the track with clearance, in order to assure that the ring will not twist. The support surfaces consist of flanges 39, which are supported from the side on the vertical or slightly inclined side walls 33 of the track.

Figure 8:
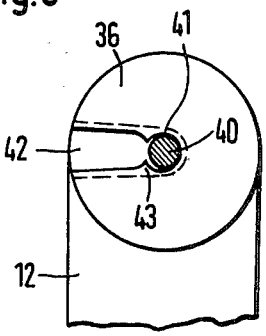
FIG. 8 shows a partial cross section along the VIII—VIII of FIG. 6.

Roller 37 is provided with trunnions 40, which can be integral with it, or the ends form an axle extending through a bore in the roller. The ends of trunnions 40 can be enlarged as in FIG. 6. The bores 41 form the ends of insertion grooves 42, whereby the groove dimensions correspond to the enlarged profile of the trunnion. The openings in side walls 36 of cutout 35 of groove 42 are narrowed to be narrower than the groove base and approximately fit the diameter of the trunnion. The opening of groove 42 is, as shown in FIG. 8, provided with a narrowing point 43 in the form of a catch, enclosing the trunnion, so that trunnions 40 are inserted in grooves 42 and then with light pressure are inserted in bores 41.

Figure 7:
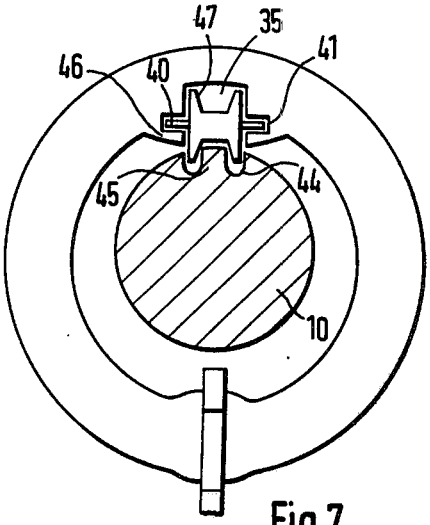
FIG. 7 shows a variation of FIG. 6.

In FIG. 7, curtain rod 10 has two grooves with a support track 45 between them. To increase the stability, the ring of FIG. 7 is completely closed and the cutout 35 is in an enlargement in the middle of the ring. The ring has radial projections 46 on the inside of both sides of the cutout, in which are provided insertion grooves 42 (sic) with trunnion bores 41 which are accessible from the side or from below, as in FIG. 8.

Figure 9:
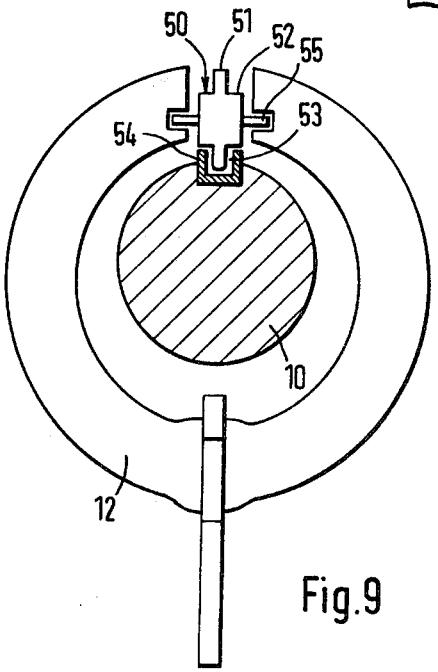
FIG. 9 shows a second variation of FIG. 6.

FIG. 9 shows a similar form of ring 12 as in FIG. 6, in the cutout 35 of which is mounted a roller 50, which has two running surfaces 52 on both sides of a rim 51. Rim 51 projects into a rim groove 53, which is worked into the curtain rod, or consists of an inserted track 54. The supporting surfaces 52 of the roller rest on the topside of the track. Rim 51 is guided in the side walls of longitudinal groove 53 with clearance. The trunnions integral with roller 50 can be installed in the bores by spreading the ring, or as in FIG. 8 can be inserted through insertion grooves into a trunnion bore.

In a preferred embodiment of the invention, in FIG. 10, curtain ring 12 is closed as in FIG. 7, and has a cutout 35, with enlargements or additional members 46 forming the necessary surface to receive a roller 61, and of which the trunnions 64 are supported in trunnion bores 41 (FIG. 8) accessible from the side or from below.

Figure 10:
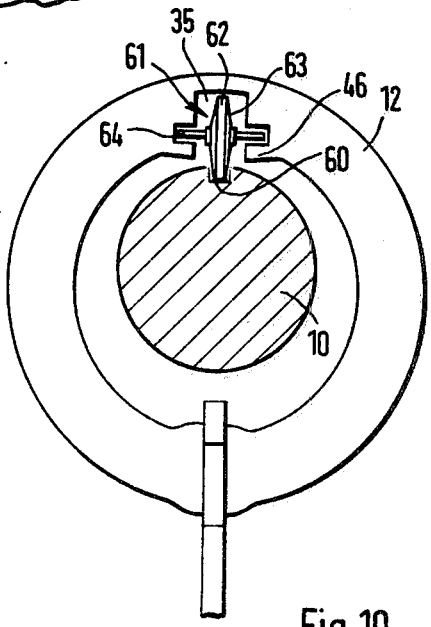
FIG. 10 shows a preferred embodiment of the invention.

As opposed to the examples of FIGS. 6, 7 and 9, roller 61 of FIG. 10 does not have a special rim, so that the roller can be narrow in axial direction. Thus the cutout 35 in ring 12 is also narrow, so that the ring is only minimally weakened. In another important feature, roller 61 is tapered radially so that its support surface 62 riding on the bottom of running groove 60 of curtain rod 10 is remarkably narrow and thus the groove can remain narrow, and the carrying capacity of the curtain rod is not lowered. Since the supporting surface lies on the outside periphery of roller 61, optimum running properties are guaranteed. The radially outwardly tapered side surfaces 63 of roller 61 normally have a small clearance from the side walls of the groove, so that the ring can be in slightly inclined position, which is necessary at the beginning of the slide movement of the curtain, in order to temper an excessive friction braking action. By the cooperation of inclined side surfaces 63 of the roller and the top opening edges of the groove, with inclined positioning of the roller, the friction remains negligeable, since it occurs in radial direction near the roller axis. With this embodiment, an additional support track in the curtain rod is not needed.

What is claimed is:

1. A curtain rod track fitting for slidably supporting a curtain or the like on a curtain rod comprising:

a closed ring member for completely encircling the curtain rod, said ring member having a recess formed in an inner portion thereof and opening toward the center of said ring member for mounting a roller member therein, said recess having a deep portion providing clearance for said roller member and a pair of notches for mounting an axle of said roller member such that said roller member is free to roll along the curtain rod and said axle is substantially transverse to the curtain rod, said roller member having tapered radial faces for engaging a portion of the curtain rod along said tapered faces for minimizing friction with the curtain rod.

2. A fitting as in claim 1 and wherein:

said roller member includes a peripheral portion adapted to roll along the curtain rod.

3. A fitting as in claim 2 and wherein:

the curtain rod has a groove formed therein, and said peripheral portion of said roller member travels along the bottom of said groove and said tapered faces travel along the sides of said groove.

4. A fitting as in claim 1 and wherein:

said notches include integrally formed retention means for said axle.

5. A fitting as in claim 4 and wherein:

said retention means comprises a portion of said notches of reduced width such that said axle is forced past said reduced width portion and is retained in position thereby.

6. A fitting as in claim 4 and wherein said notches open toward the center of said ring member.

7. A fitting as in claim 4 and wherein said notches open in a direction perpendicular to the plane of said ring member and substantially parallel to the curtain rod.

* * * * *